US008267283B2

(12) United States Patent
Staton

(10) Patent No.: US 8,267,283 B2
(45) Date of Patent: Sep. 18, 2012

(54) PERSONAL HYDRATION SYSTEM

(75) Inventor: John M. Staton, Fairport, NY (US)

(73) Assignee: Nalge Nunc International Corporation, Rochester, NY (US)

( * ) Notice: Subject to any disclaimer, the term of this patent is extended or adjusted under 35 U.S.C. 154(b) by 440 days.

(21) Appl. No.: 12/634,254

(22) Filed: Dec. 9, 2009

(65) Prior Publication Data

US 2011/0006084 A1 Jan. 13, 2011

Related U.S. Application Data

(63) Continuation-in-part of application No. 29/340,030, filed on Jul. 13, 2009, now Pat. No. Des. 640,466.

(51) Int. Cl.
*B67D 7/84* (2010.01)

(52) U.S. Cl. ..... 222/175; 222/465.1; 222/529; 224/148.2

(58) Field of Classification Search ..... 215/396–398; 220/317, 318, 696, 710.5, 741, 752, 756, 220/761, 770, 846; 222/105, 175, 210, 323, 222/324, 465.1, 475, 482, 526, 527, 529, 222/530, 534, 538; 239/327, 328, 375, 525; 224/148.1, 148.2; 248/79
See application file for complete search history.

(56) References Cited

U.S. PATENT DOCUMENTS 2,516,728 A * 7/1950 Smith ..... 222/108
5,085,349 A * 2/1992 Fawcett ..... 220/703
5,195,661 A * 3/1993 Light ..... 222/105
5,362,165 A * 11/1994 Kluga et al. ..... 401/9
5,727,714 A 3/1998 Fawcett
6,247,619 B1 * 6/2001 Gill et al. ..... 222/175
6,675,998 B2 1/2004 Forsman et al.
6,722,533 B2 4/2004 Skillern
(Continued)

FOREIGN PATENT DOCUMENTS

WO WO 2010151848 A2 * 12/2010
(Continued)

OTHER PUBLICATIONS

Thermo Fisher Scientific; Nalgene CXC Rapid Fill, hydration pack product overview; 1 page; Sep. 3, 2008; [retrieved on Apr. 6, 2012] Retrieved from the Internet: <URL: http://web.archive.org/web/20080903053844/http://www.nalgene-outdoor.com/store/detail.aspx?ID=1217>.*

*Primary Examiner* — Kevin P Shaver
*Assistant Examiner* — Patrick M Buechner
(74) *Attorney, Agent, or Firm* — Wood, Herron & Evans, LLP

(57) ABSTRACT

In one embodiment, a personal hydration system includes a fluid reservoir having first and second spaced apart apertures. A first port is coupled to the first aperture, and a second port is coupled to the second aperture. A flexible tube has a first end that is coupled to the second port for communication with an interior of the fluid reservoir. The personal hydration system further includes a handle having a first end coupled to the first port, and a second end coupled to the second port. A channel near the second end of the handle extends over at least a portion of the first end of the tube and thereby captures the first end of the tube between the channel and the fluid reservoir.

10 Claims, 5 Drawing Sheets

U.S. PATENT DOCUMENTS

| | | | | |
|---|---|---|---|---|
| D517,308 | S | 3/2006 | Khalifa | |
| 7,070,075 | B2 | 7/2006 | Forsman et al. | |
| 7,073,688 | B2 | 7/2006 | Choi et al. | |
| 7,083,063 | B2 | 8/2006 | Lien | |
| 7,464,837 | B2 * | 12/2008 | Hoskins | 222/175 |
| D640,466 | S * | 6/2011 | Staton | D3/202 |
| 2003/0129464 | A1 * | 7/2003 | Becerra et al. | 429/25 |
| 2005/0251090 | A1 * | 11/2005 | Hoskins | 604/76 |
| 2006/0163284 | A1 * | 7/2006 | Karl et al. | 222/175 |
| 2008/0002922 | A1 * | 1/2008 | Wang | 383/200 |
| 2008/0308578 | A1 * | 12/2008 | Skillern et al. | 222/209 |
| 2010/0213223 | A1 * | 8/2010 | Ballentine | 224/148.2 |

FOREIGN PATENT DOCUMENTS

| | | | |
|---|---|---|---|
| WO | WO 2011003110 | A2 * | 1/2011 |

* cited by examiner

PERSONAL HYDRATION SYSTEM

CROSS-REFERENCE TO RELATED APPLICATIONS

This application is a continuation-in-part of, and claims the benefit of priority to U.S. Design application Ser. No. 29/340,030, filed Jul. 13, 2009, now U.S. Pat. No. D640,466, the disclosure of which is incorporated by reference herein in its entirety.

TECHNICAL FIELD

The present invention relates generally to fluid reservoirs and, more particularly, to a personal hydration system including a fluid reservoir.

BACKGROUND

Personal hydration systems have been used to provide fluids to persons engaging in physical activities such as hiking, cycling, running, and various other activities. Conventional personal hydration systems include a reservoir, typically a flexible bladder, for containing a fluid to be consumed by the user, and a drinking tube communicating with the reservoir whereby the user can receive fluids stored in the reservoir. Personal hydration systems may be carried in a pack that can be worn on the back or waist of a user. Because the reservoir is flexible, it is often difficult to carry and/or hold the reservoir while filling the reservoir with fluid. Another drawback of conventional personal hydration systems is that the drinking tube often interferes with the insertion or removal of the reservoir from its pack. The drinking tube may also become entangled or caught on other objects during use.

A need therefore exists for an improved personal hydration system that overcomes these and various other drawbacks of conventional personal hydration systems.

SUMMARY

The present invention overcomes the foregoing and other shortcomings and drawbacks of personal hydration systems heretofore known. While the invention will be described in connection with certain embodiments, it will be understood that the invention is not limited to these embodiments. On the contrary, the invention includes all alternatives, modifications and equivalents as may be included within the spirit and scope of the present invention.

According to one aspect of the present invention, a personal hydration system includes a fluid reservoir having first and second spaced apart apertures. A first port is coupled to the first aperture, and a second port is coupled to the second aperture. A flexible tube has a first end that is coupled to the second port for communication with an interior of the fluid reservoir. The personal hydration system further includes a handle having a first end coupled to the first port, and a second end coupled to the second port. A channel near the second end of the handle extends over at least a portion of the first end of the tube and thereby captures the first end of the tube between the channel and the fluid reservoir.

In another aspect of the present invention, the second end of the handle is selectively removably coupled to the second port. In yet another aspect of the present invention, a groove on the handle, generally between the channel and the first end of the handle, guides at least a portion of the tube as it extends from the channel.

The above and other objects and advantages of the present invention shall be made apparent from the accompanying drawings and the description thereof.

BRIEF DESCRIPTION OF THE FIGURES

The accompanying drawings, which are incorporated in and constitute a part of this specification, illustrate exemplary embodiments of the invention and, together with a general description given above, and the detailed description given below, serve to explain the invention in sufficient detail to enable one of ordinary skill in the art to which the invention pertains to make and use the invention.

DETAILED DESCRIPTION

Figure 1:
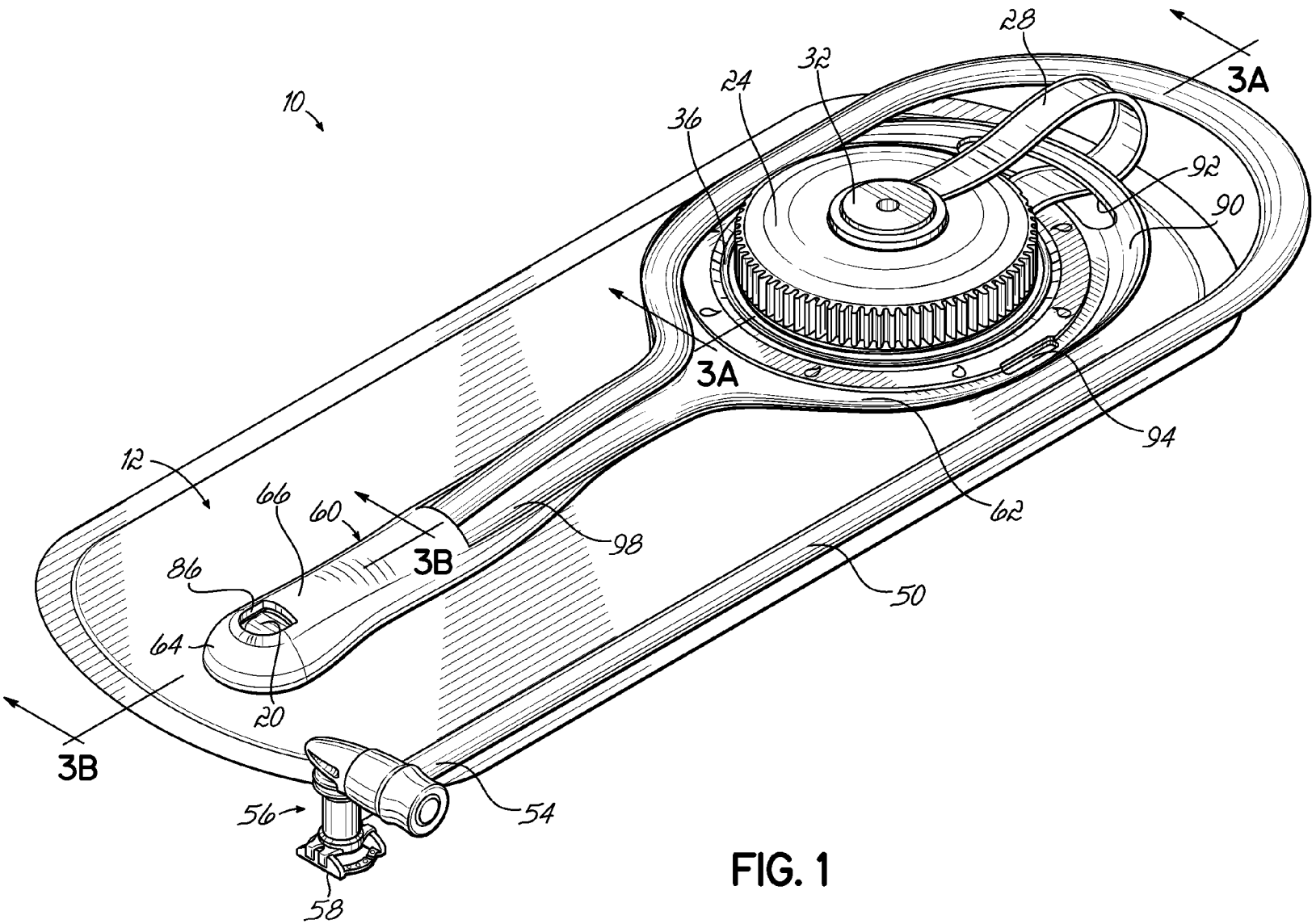
FIG. 1 is a perspective view of an unfilled personal hydration system according to one embodiment of the present invention.

FIGS. 1, 1A, 3A, and 3B depict a personal hydration system 10 according to one embodiment of the present invention. The personal hydration system 10 includes a fluid reservoir 12 (shown empty) for receiving fluids for storage and consumption by a user of the personal hydration system 10. In the embodiments shown, the fluid reservoir 12 comprises a flexible bladder having first and second spaced apart apertures 14, 16 formed though a wall of the flexible bladder, with respective first and second ports 18, 20 coupled thereto. The first port 18 defines a relatively wide spout that fluidly communicates with an interior cavity defined by the flexible bladder and facilitates filling the fluid reservoir 12 with a liquid. The first port 18 includes screw threads 22 for securing a closure 24 over the first port 18 for sealing the filled fluid reservoir 12. In the embodiment shown, the closure 24 includes screw threads 26 that are complementary to the screw threads 22 on the first port 18, and the closure 24 may be coupled to the reservoir 12, adjacent the first port 18, by a tether 28. A first end 30 of the tether 28 is secured by a fastener 32 to the closure 24, and a second end 34 of the tether 28 includes a ring 36 that can be removably received around the first port 18 so that the closure 24 is retained by the tether 28 when the closure 24 is removed from the first port 18 for filling the fluid reservoir 12.

The second aperture 16 and second port 20 are spaced a distance apart from the first aperture 14 and first port 18. In the embodiment shown, the second port 20 includes a first end 40 that defines a tube fitting and a second end 42 that is coupled to the second aperture 16 of the fluid reservoir 12, as depicted in FIGS. 3B and 4A-4C. The first and second ports 18, 20 may be operatively coupled to the first and second apertures 14, 16 of the fluid reservoir 12 by heat sealing, radio frequency welding, adhesives, or various other methods suitable to provide a watertight seal between the first and second ports 18, 20 and the first and second apertures 14, 16, respectively. The first and second ports 18, 20 may be provided with wide flange portions 44, 46 to provide reinforcement and/or strain relief to the interface between the first and second ports 18, 20 and the fluid reservoir 12.

The personal hydration system 10 further includes a flexible tube 50 having a first end 52 operatively coupled to the tube fitting of the second port 20 for communication with an interior of the fluid reservoir 12 through the second aperture 16. A second end 54 of the tube 50 is provided with a mouthpiece 56 for use by the user to receive liquid from the fluid reservoir 12 through the tube 50. In the exemplary embodiment shown, the mouthpiece 56 is a bite-actuated mouthpiece that can be actuated from a closed configuration to an open configuration when a user bites upon the mouthpiece 56, or otherwise compresses the mouthpiece 56 with the user's lips or teeth. A magnetic coupling 58 may be provided to facilitate securing the mouthpiece 56 to a portion of a pack (not shown). While a bite-actuated mouthpiece is shown and described herein, it will be appreciated that the mouthpiece may alternatively be a manually-actuated mouthpiece, or may comprise various other configurations suitable to facilitate receiving liquid from the fluid reservoir 12 through the tube 50.

Figure 1A:
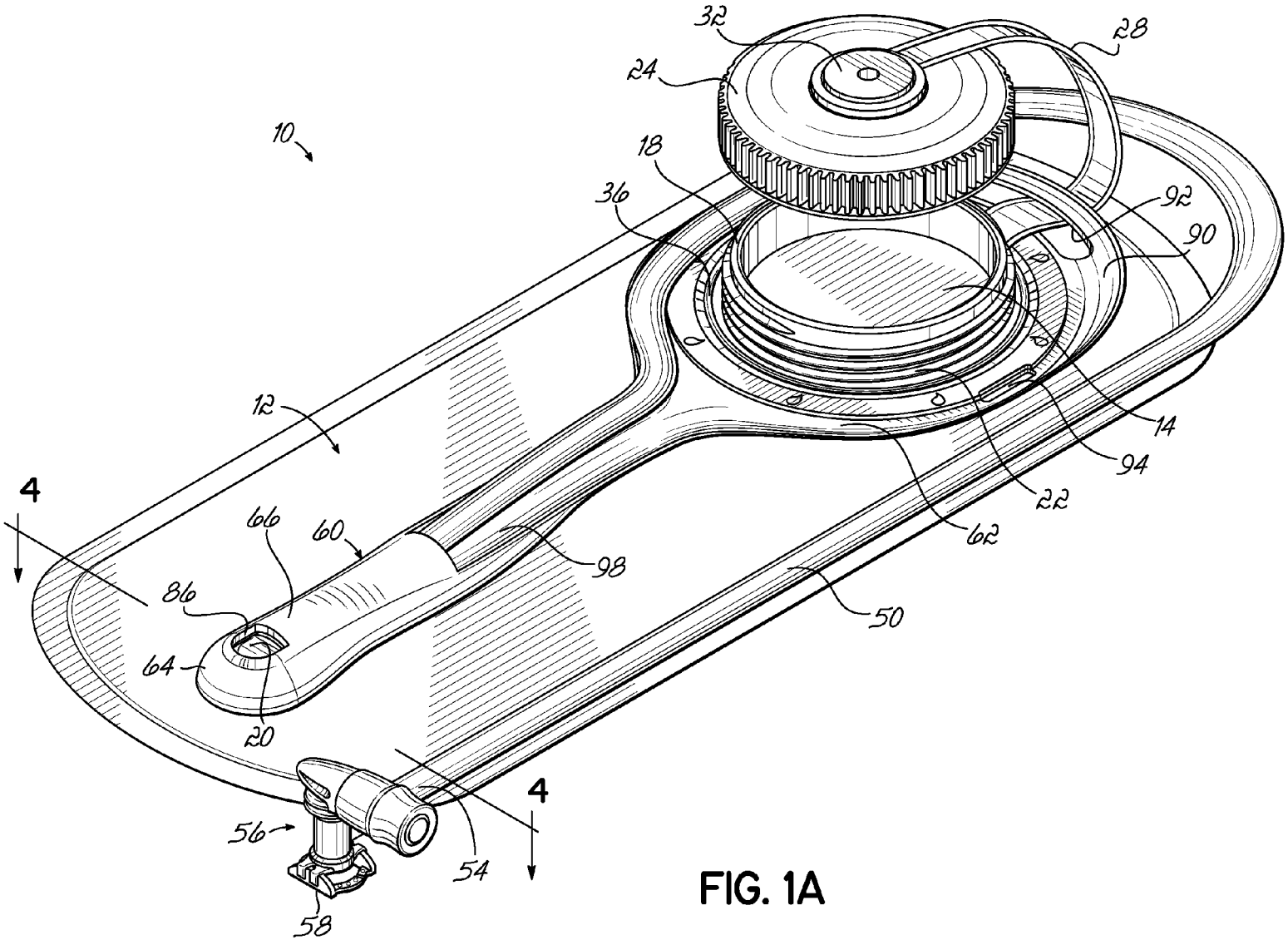
FIG. 1A is a perspective view of the personal hydration system of FIG. 1 with the closure removed.
Figure 2:
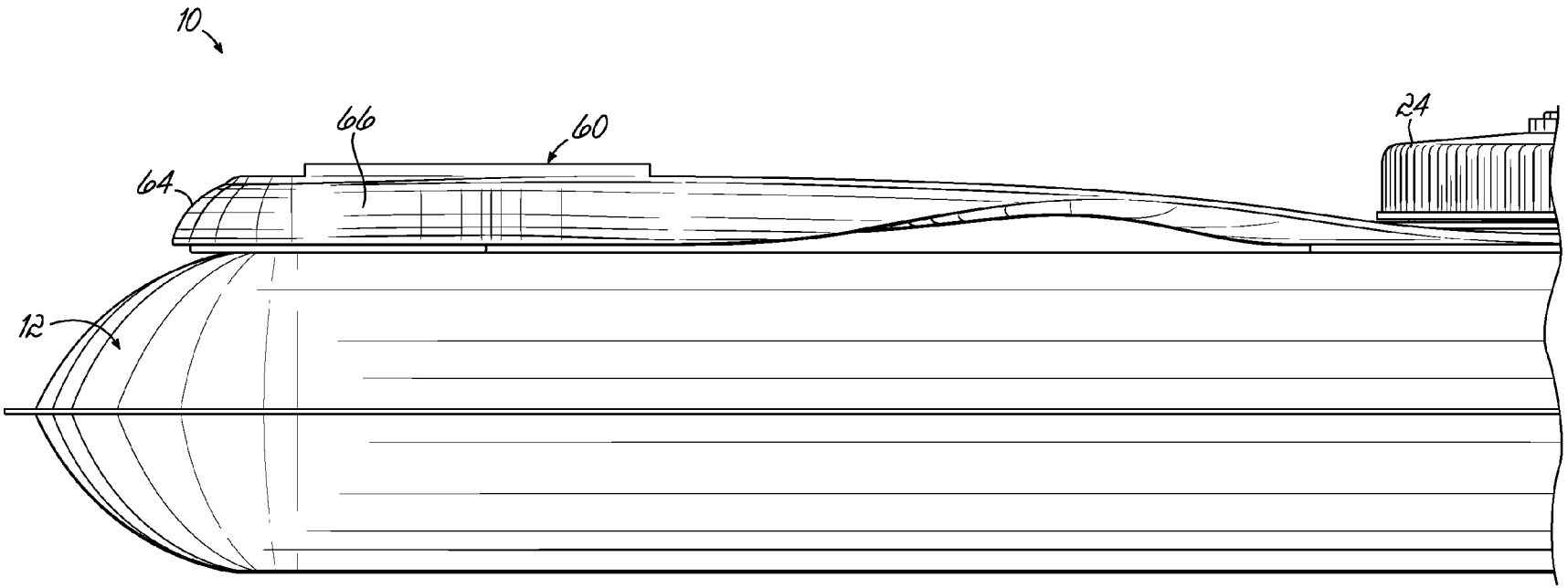
FIG. 2 is a partial elevation view of the personal hydration system of FIG. 1, in a filled condition.

With continued reference to FIGS. 1, 1A, 3A, and 3B, and referring to FIG. 2, the personal hydration system 10 further includes a handle 60 to facilitate carrying and/or holding the reservoir 12, such as when the reservoir 12 is being filled with liquid through the first port 18, or when the reservoir 12 is being inserted into or removed from a pack. In the embodiment shown, the handle 60 extends generally between the first and second ports 18, 20 and has a first end 62 coupled to the first port 18 and a second end 64 coupled to the second port 20. A channel 66 is defined on the handle 60, proximate the second end 64 of the handle 60, and extends over at least a portion of the first end 52 of the tube 50 to define a passageway between the handle 60 and the fluid reservoir 12 through which the tube 50 may extend in a direction generally toward the second port 20. The channel 66 thereby captures the first end 52 of the tube 50 between the handle 60 and the fluid reservoir 12 and provides reinforcement and strain relief to the tube 50, generally proximate the first end 52 of the tube 50.

Figure 4C:
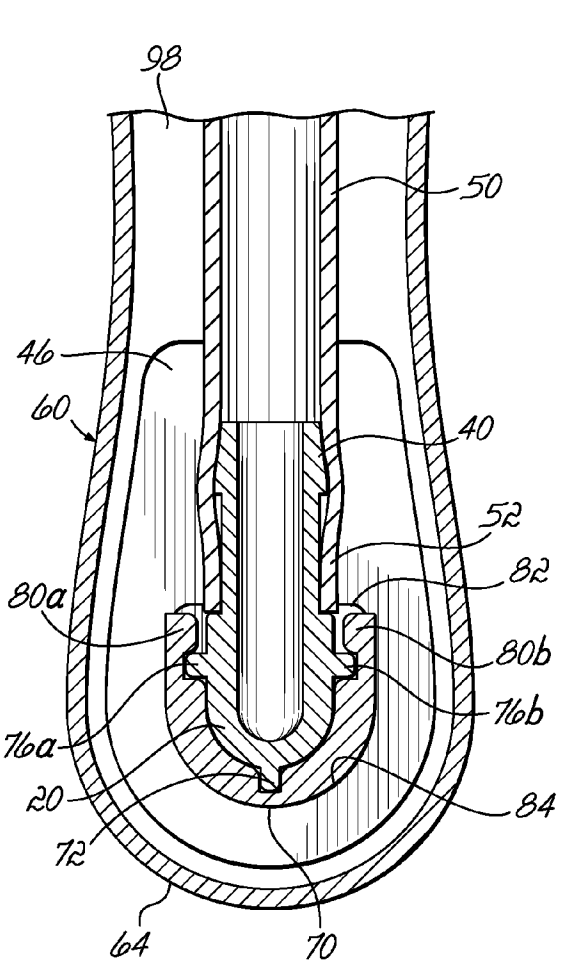
FIGS. 4A-4C are partial cross-sectional views taken along line 4-4 of FIG. 1A and illustrating connection of the second port with the second end of the handle.
Figure 4B:
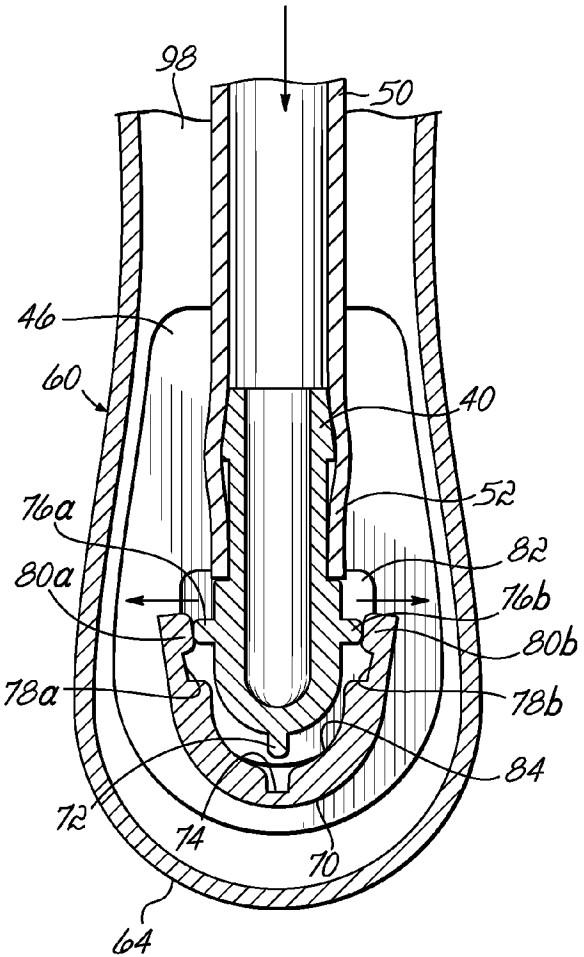
Figure 4A:
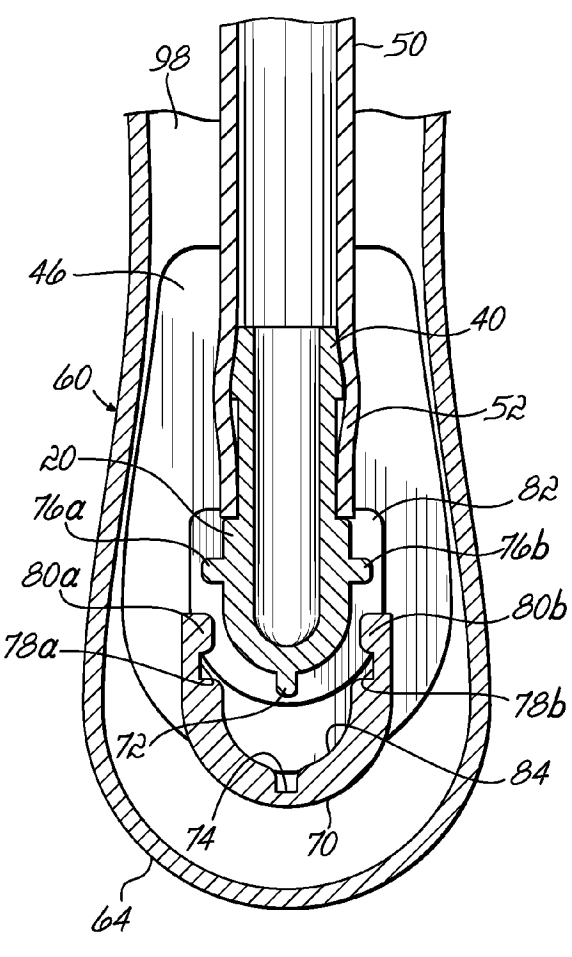

In the embodiment shown, the second end 64 of the handle 60 is configured to be removably coupled to the second port 20, as shown in FIGS. 4A-4C, to facilitate removing and/or replacing the tube 50 for cleaning or other purposes. The flexibility of the bladder that forms the reservoir 12 facilitates removal of the handle 60, which may be relatively more rigid, by permitting the second port 20 to be moved generally in the direction of the first port 18. In this embodiment, the second port 20 is sized and shaped to be received within a receptacle 70 on the second end 64 of the handle 60. A central alignment tab 72 projecting from the second port 20 aligns with and is received in a central slot 74 defined on the receptacle 70, and side tabs 76*a*, 76*b* projecting from the second port 20 are received in corresponding side slots 78*a*, 78*b* on the receptacle 70. As the second port 20 is moved within the receptacle 70, resilient fingers 80*a*, 80*b* positioned along the lateral sides of the receptacle 70 are pushed outwardly by the side tabs 76*a*, 76*b* on the second port 20 (FIG. 4B) and then spring back to secure the second port 20 within the receptacle 70 in a snap-fit manner (FIG. 4C). One or more generally arcuately-shaped rims 82 extending peripherally around the second port 20 engage complementarily shaped rims 84 on the receptacle 70 to facilitate alignment of the second port 20 within the receptacle 70 and to retain the second port 20 within the receptacle 70 of the second end 64 of the handle 60 with the fingers 80*a*, 80*b* snap-fit over the side tabs 76*a*, 76*b* of the second port 20. As shown in FIGS. 1 and 1A, a window 86 may be provided at the second end 64 of the handle 60. When the second end 64 of the handle 60 is coupled to the second port 20, the second port 20 may be viewed through window 86 to ensure that the handle 60 is properly coupled to the second port 20.

Figure 3A:
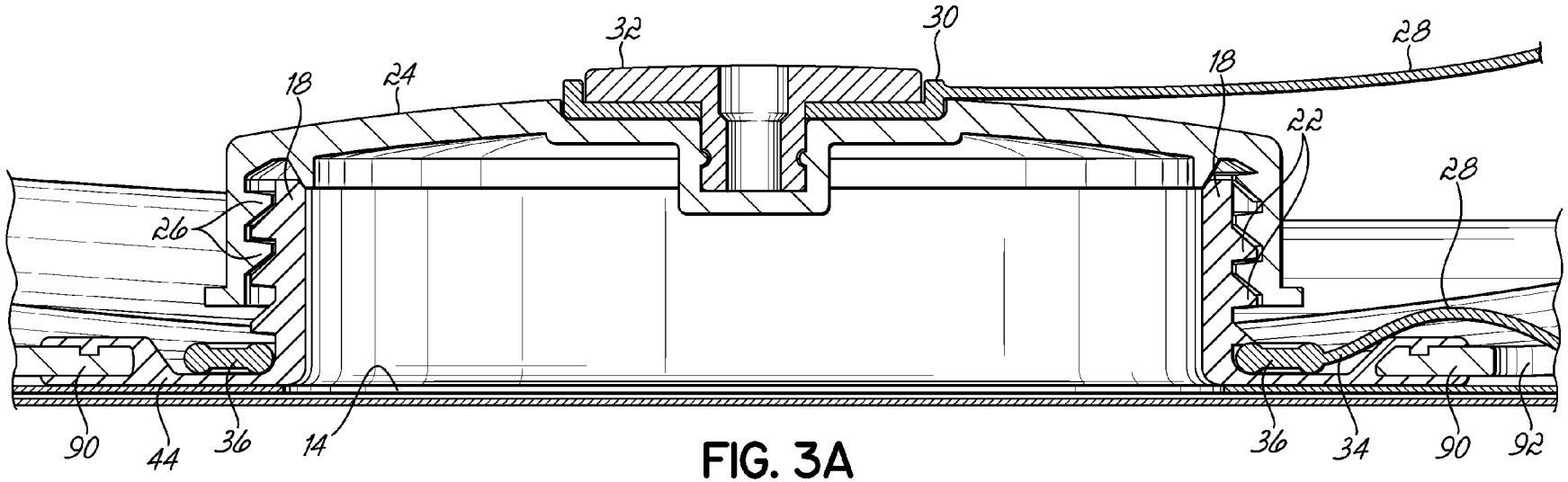
FIG. 3A is a partial cross-sectional view taken along line 3A-3A of FIG. 1.
Figure 3B:
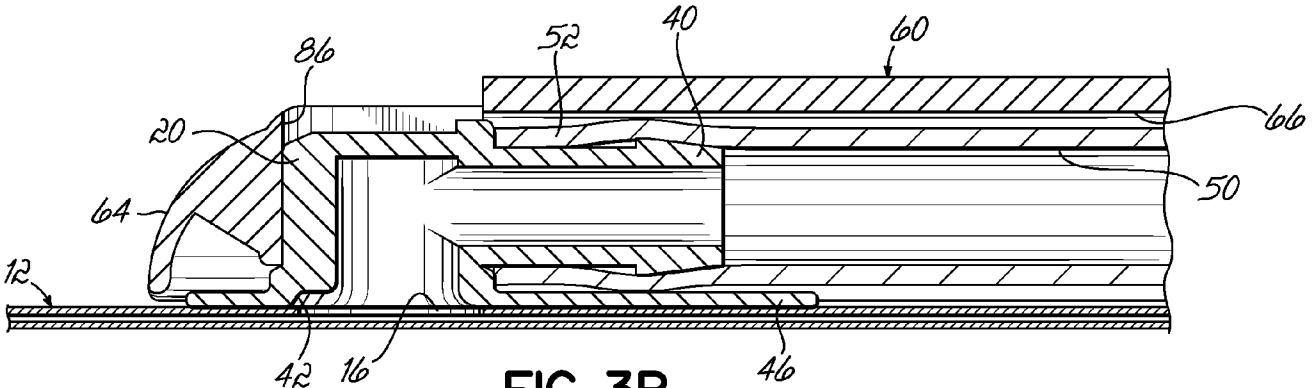
FIG. 3B is a partial cross-sectional view taken along line 3B-3B of FIG. 1.

Referring again to FIGS. 1, 1A, and 3A, the first end 62 of the handle 60 may include a support ring 90 that generally circumscribes the first port 18. In the embodiment shown, the first port 18 is formed from a polymeric material that is molded over the support ring 90 at the first end 62 of the handle 60, as depicted in FIG. 3A. One or more apertures 92, 94 may be formed through the support ring 90. In the exemplary embodiment shown, the tether 28 connecting the closure 24 to the first port 18 extends through a first aperture 92 in the support ring 90. Apertures 94 may also be provided on opposite sides of the first port 18 to facilitate routing and securing the tube 50 along a particular side of the fluid reservoir 12, such as with a strap or tie, as may be desired by a user of the personal hydration system 10.

The handle 60 may further include a generally concave groove 98 that extends between the channel 66 and the first end 62 of the handle 60. The groove 98 may be shaped to help guide and align the tube 50 with the handle 60 as the tube 50 extends from the channel 66. If desired, a user may route the tube 50 along one side of the first port 18 and secure a portion of the tube 50 adjacent the first port 18 with a strap or tie extending through one of the apertures 94 provided on the sides of the first port 18. This type of arrangement may help to retain the second end 54 of the tube 50, with the mouthpiece 56, along a desired side of the fluid reservoir 12 for convenient access by a user.

In use, the first end 52 of the tube 50 is connected to the fitting at the first end 40 of the second port 20. The handle 60 is coupled to the second port 20, as described above, such that the channel 66 extends over at least a portion of the tube 50 and provides reinforcement to the first end 52 of the tube 50 where it is coupled to the second port 20. The handle 60 can then be used to facilitate filling the fluid reservoir 12 and placing the fluid reservoir 12 into a carrying pack.

While various aspects in accordance with the principles of the invention have been illustrated by the description of various embodiments, and while the embodiments have been described in considerable detail, they are not intended to restrict or in any way limit the scope of the invention to such detail. The various features shown and described herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A personal hydration system, comprising:

a fluid reservoir having a first aperture and a second aperture spaced from said first aperture;

a first port coupled to said first aperture;

a second port coupled to said second aperture;

a flexible tube having a first end coupled to said second port for communication with an interior of said reservoir through said second aperture;

a handle having first and second ends;

a channel proximate said second end of said handle, said channel extending over at least a portion of said tube, proximate said first end of said tube, thereby capturing said first end of said tube between said channel and said fluid reservoir; and a closure selectively removably coupled to said first port.

2. The personal hydration system of claim 1, wherein said first end of said handle is coupled to said first port, said second end of said handle is coupled to said second port.

3. The personal hydration system of claim 1, wherein said second end of said handle is selectively removably coupled to said second port.

4. The personal hydration system of claim 1, further comprising:

a groove on said handle between said channel and said first end of said handle for guiding at least a portion of said tube extending from said channel.

5. The personal hydration system of claim 1, further comprising:

a support ring proximate said first end of said handle and circumscribing said first port.

6. The personal hydration system of claim 5, wherein said first port is formed from polymeric material molded over said support ring.

7. A personal hydration system, comprising:

a fluid reservoir having a first aperture and a second aperture spaced from said first aperture;

a first port coupled to said first aperture;

a second port coupled to said second aperture;

a flexible tube having a first end coupled to said second port for communication with an interior of said reservoir through said second aperture;

a handle having first and second ends, said first end coupled to said first port, said second end coupled to said second port;

a channel proximate said second end of said handle, said channel having an open side facing said fluid reservoir when said second end of said handle is coupled to said second port thereby defining a passageway between said fluid reservoir and said channel;

at least a portion of said flexible tube proximate said first end of said flexible tube extending through said passageway defined between said fluid reservoir and said channel; and a closure selectively removably coupled to said first port.

8. A personal hydration system, comprising:

a fluid reservoir including an interior for storing fluid therein;

an aperture in fluid communication with said interior of said fluid reservoir;

a flexible tube having a first end coupled to said aperture and providing fluid communication with said interior of said fluid reservoir through said aperture; and a handle operatively coupled to said fluid reservoir and including a channel;

said channel capturing at least a portion of said tube proximate said first end between said channel and said fluid reservoir.

9. The personal hydration system of claim 8, further comprising:

a groove on said handle, said groove guiding at least a portion of said tube extending from said channel.

10. A personal hydration system, comprising:

a fluid reservoir including an interior for storing fluid therein;

an aperture in fluid communication with said interior of said fluid reservoir;

a flexible tube providing fluid communication with said interior of said fluid reservoir through said aperture;

a handle operatively coupled to said fluid reservoir and including a channel;

said channel capturing at least a portion of said tube between said channel and said fluid reservoir; and a groove on said handle, said groove guiding at least a portion of said tube extending from said channel.

* * * * *